US008152491B2

(12) United States Patent
Wakabayashi et al.

(10) Patent No.: US 8,152,491 B2
(45) Date of Patent: Apr. 10, 2012

(54) PUMP USING UNIMORPH DIAPHRAGM

(75) Inventors: Masanori Wakabayashi, Tokyo (JP); Yasumasa Oki, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 1006 days.

(21) Appl. No.: 12/093,300

(22) PCT Filed: Nov. 1, 2006

(86) PCT No.: PCT/JP2006/321871

§ 371 (c)(1),
(2), (4) Date: May 9, 2008

(87) PCT Pub. No.: WO2007/055136

PCT Pub. Date: May 18, 2007

(65) Prior Publication Data

US 2009/0162224 A1 Jun. 25, 2009

(30) Foreign Application Priority Data

Nov. 9, 2005 (JP) ..... 2005-325450

(51) Int. Cl.
*F04B 43/04* (2006.01)

(52) U.S. Cl. ..... 417/413.2; 417/542; 310/330; 310/331; 92/102

(58) Field of Classification Search ..... 417/413.2, 417/542; 310/330, 331, 324
See application file for complete search history.

(56) References Cited

U.S. PATENT DOCUMENTS

| | | | | |
|---|---|---|---|---|
| 5,562,479 | A * | 10/1996 | Pallas et al. | 439/404 |
| 6,446,611 | B2 * | 9/2002 | Ishikawa | 123/509 |
| 2004/0021398 | A1 * | 2/2004 | East | 310/311 |
| 2005/0019180 | A1 * | 1/2005 | Seto et al. | 417/413.1 |
| 2005/0139002 | A1 * | 6/2005 | Onishi | 73/168 |

FOREIGN PATENT DOCUMENTS

| | | |
|---|---|---|
| JP | 2-149880 | 12/1990 |
| JP | 3-112588 | 11/1991 |

(Continued)

OTHER PUBLICATIONS

International Search Report issued Dec. 5, 2006 in International (PCT) Application No. PCT/JP2006/321871.

*Primary Examiner* — Devon C Kramer
*Assistant Examiner* — Dominick L Plakkoottam
(74) *Attorney, Agent, or Firm* — Wenderoth, Lind & Ponack, L.L.P.

(57) ABSTRACT

A pump using a piezoelectric diaphragm is designed to allow the diaphragm to be supported appropriately and accurately and to facilitate assembly of housing members. The peripheral edge of a sheet metal of a unimorph diaphragm 40 on the side thereof facing a first housing member 14 is pressed and supported with the ridge of an annular projection 52 annularly provided along the peripheral edge of a vent chamber 38. The first to third housing members 14, 16 and 30 are stacked on one another, and the first and third housing members 14 and 30 are welded together by ultrasonic welding such that the first and second housing members 14 and 16 abut against each other at abutting portions 66 and 68 and the second and third housing members 16 and 30 abut against each other at abutting portions 70 and 72, thereby definitely determining the positional relationship between the housing members.

11 Claims, 6 Drawing Sheets

FOREIGN PATENT DOCUMENTS

| | | | |
|---|---|---|---|
| JP | 3-112589 | | 11/1991 |
| JP | 2000-265963 | | 9/2000 |
| JP | 2001-323879 | | 11/2001 |
| JP | 2001323879 | A * | 11/2001 |
| JP | 2002-130135 | | 5/2002 |
| JP | 2003-28068 | | 1/2003 |
| JP | 2004-353493 | | 12/2004 |
| JP | 2005-248713 | | 9/2005 |

* cited by examiner

[Fig. 1]
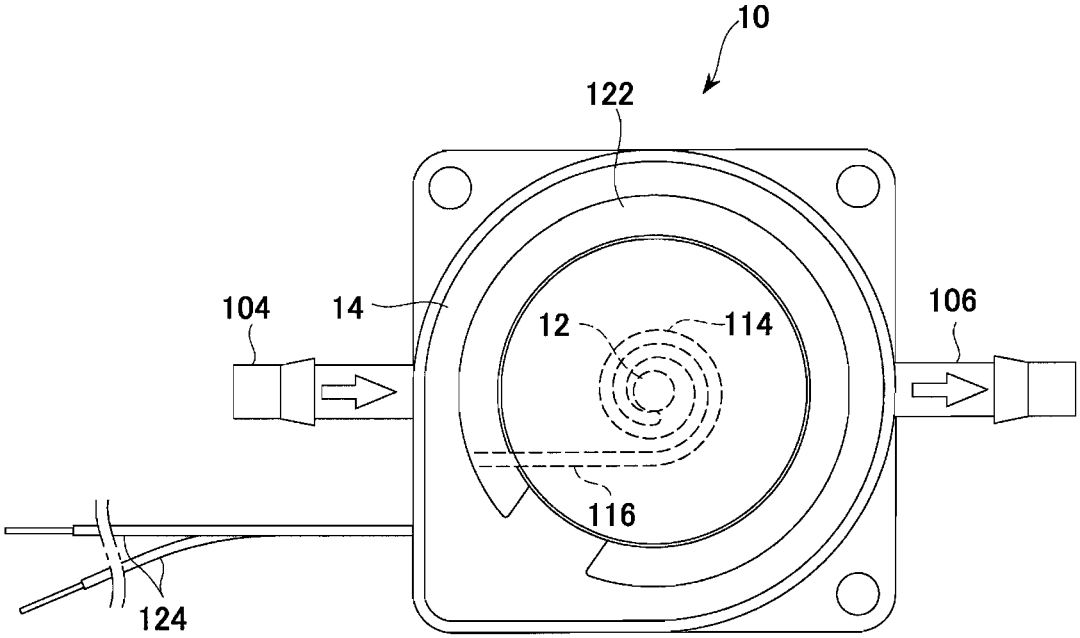
[Fig. 2]
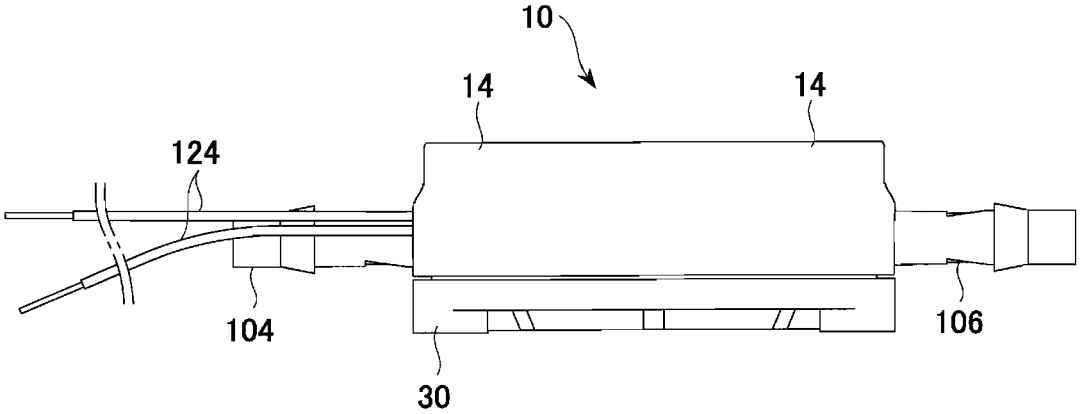

[Fig. 3]
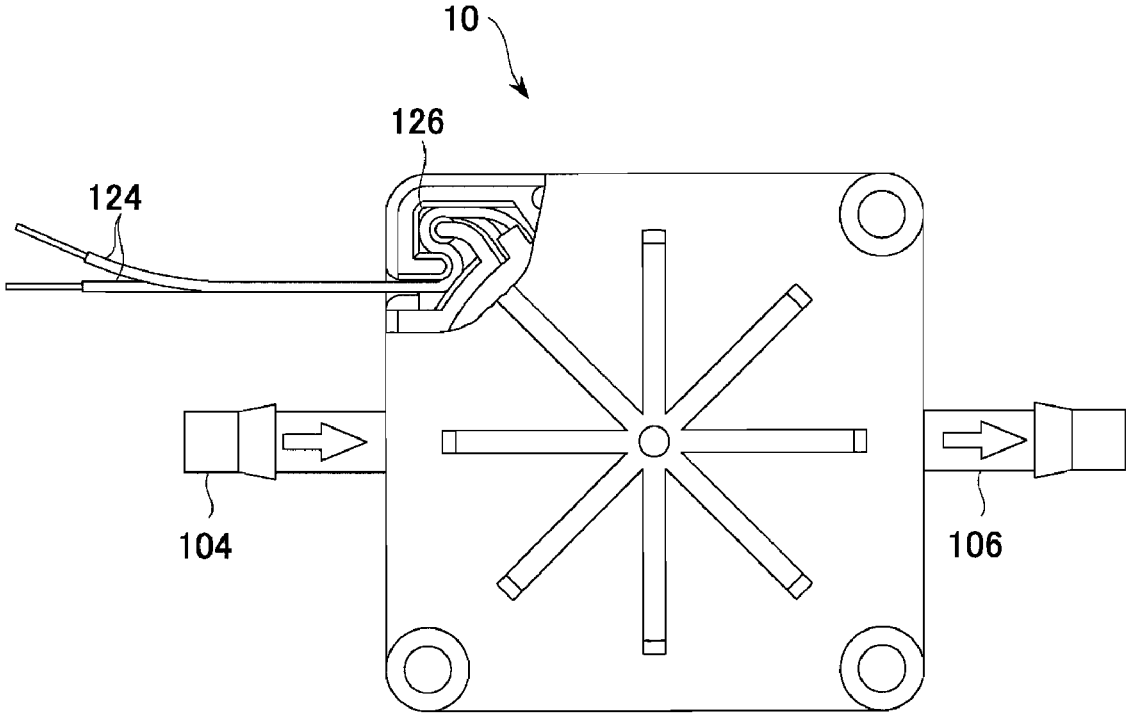

[Fig. 4]
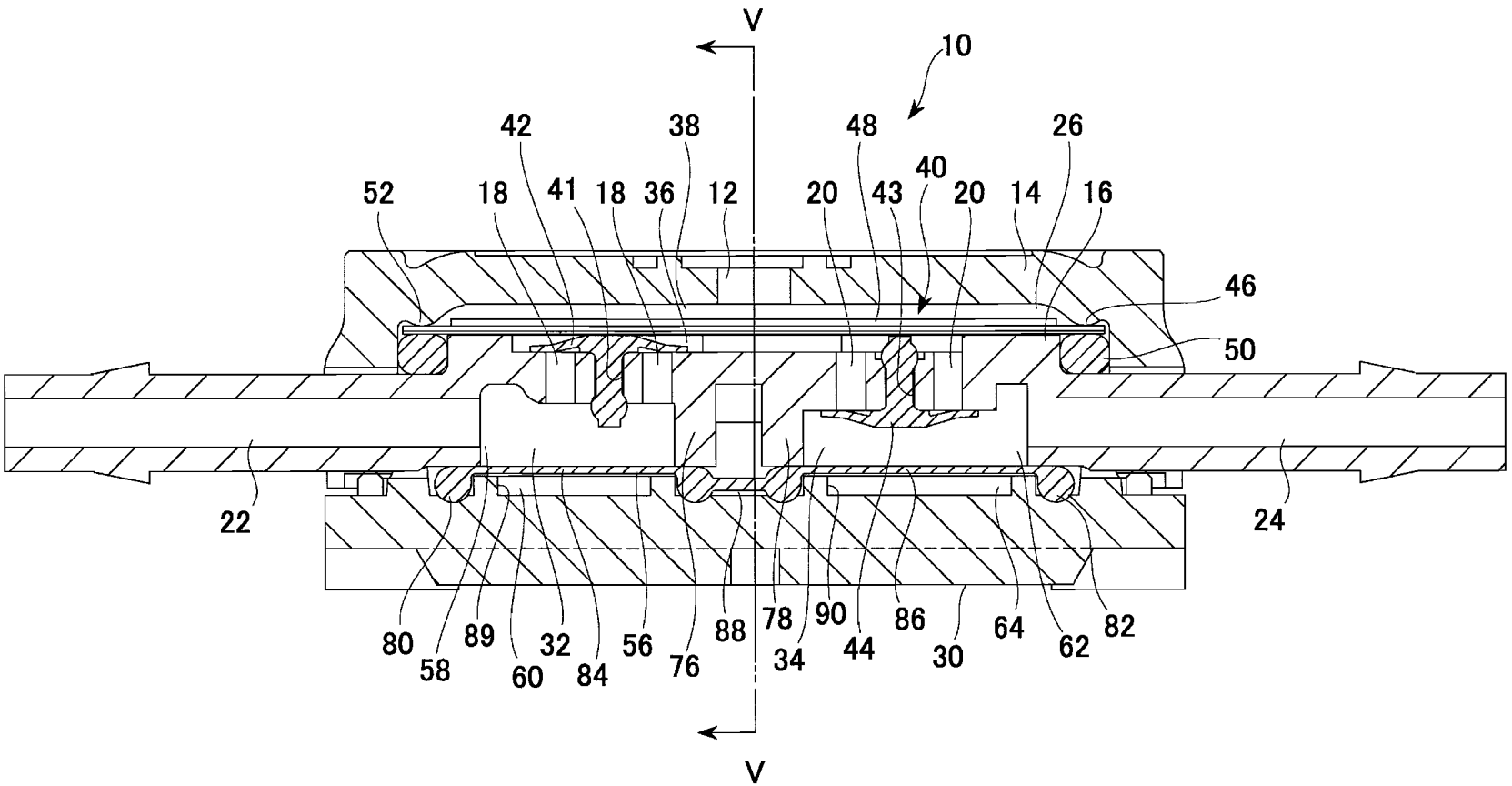

[Fig. 5]
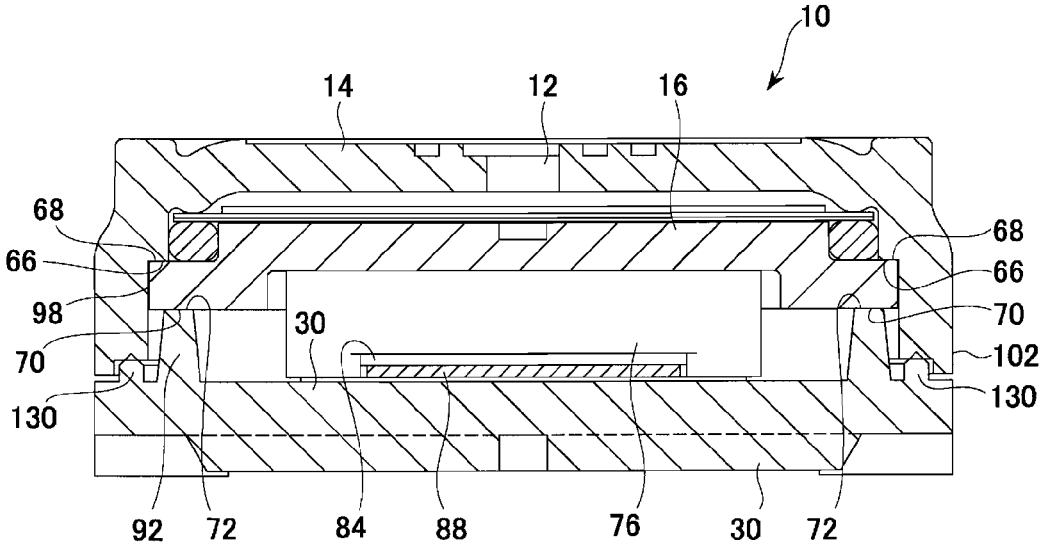

[Fig. 6]
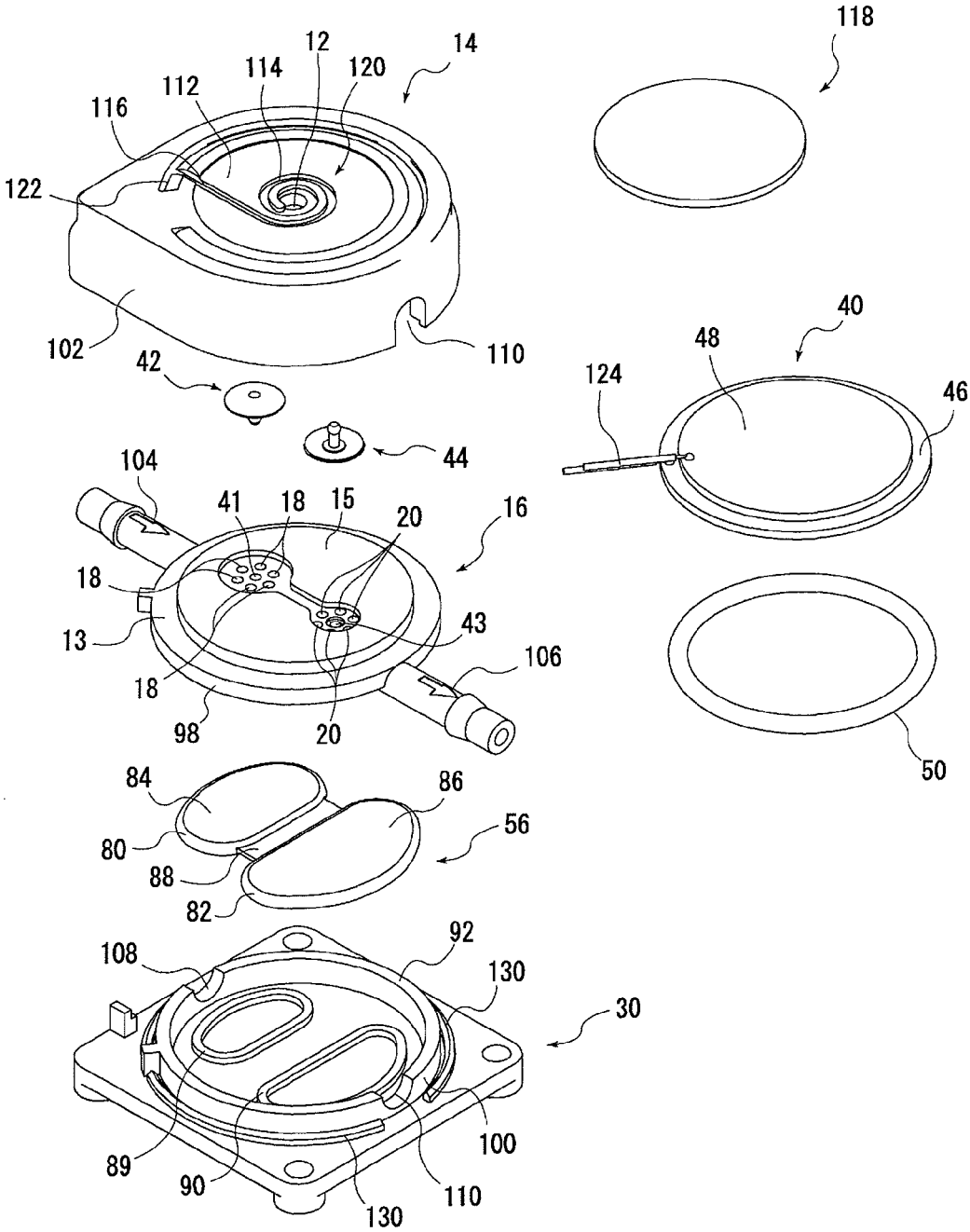

[Fig. 7]
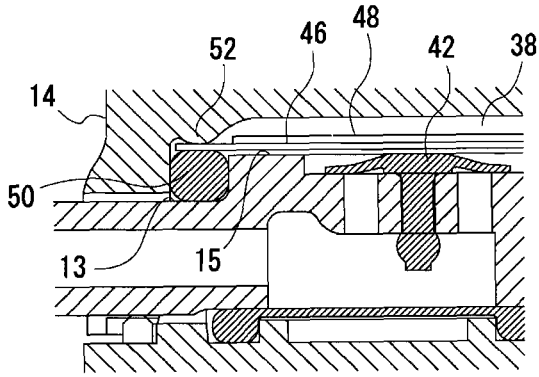
[Fig. 8]
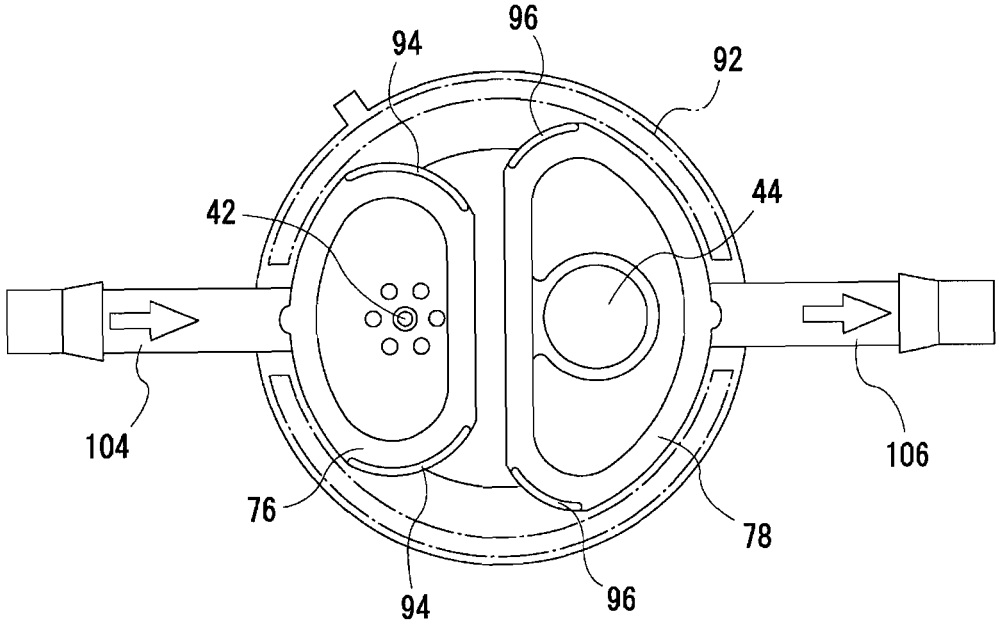

PUMP USING UNIMORPH DIAPHRAGM

TECHNICAL FIELD

The present invention relates to a pump in which a voltage is periodically applied to a piezoelectric element bonded to a surface of a sheet metal to vibrate the sheet metal, thereby driving a fluid. More particularly, the present invention relates to a pump using a unimorph having a piezoelectric element bonded to only one side of a sheet metal as a fluid driving element.

BACKGROUND ART

There has been known a pump using a diaphragm having a piezoelectric element bonded to a surface of a sheet metal. as a fluid driving element The pump has a housing comprising first, second and third housing members stacked on one another. The diaphragm is stretched between the first and second housing members to form a pump chamber between the diaphragm and the second housing member. The second housing member is provided with a fluid suction opening and a fluid discharge opening that open on a side surface thereof. The fluid suction opening and the fluid discharge opening are communicated with the pump chamber through respective check valves. Thus, a fluid is sucked into and discharged from the pump chamber by vibrating the diaphragm. In addition, a partition is provided between the second and third housing members to form an inlet chamber and an outlet chamber on the second housing member side and pulsation absorbing chambers on the third housing member side. More specifically, the inlet chamber is formed between the fluid suction opening and the pump chamber. The outlet chamber is formed between the fluid discharge opening and the pump chamber. The pulsation absorbing chambers are formed to face the inlet chamber and the outlet chamber, respectively, across the partition (see Patent Document 1).

The diaphragm used in this type of pump is a bimorph diaphragm having piezoelectric elements bonded to both sides of a sheet metal. The diaphragm is entirely covered with silicon to ensure electrical insulating properties.

Patent Document 1: Japanese Patent Application Publication No. 2000-265963

DISCLOSURE OF THE INVENTION

Problem to be Solved by the Invention

The above-described conventional pump has the following problems.

The process of coating the diaphragm with silicon requires a complicated operation, resulting in an increase in production cost of the diaphragm.

The diaphragm is installed by being held between the first and second housing members to form a pump chamber between itself and the second housing member. It is important in determining the discharge flow rate and discharge pressure of the pump to accurately define the space width set between the diaphragm and the second housing member, i.e. the height of the pump chamber. In this regard, silicon provided over the diaphragm is flexible. Therefore, the deformation of the silicon when the diaphragm is clamped between the first and second housing members is undeterminable. Hence, it is difficult to determine the set position of the diaphragm relative to the second housing member. Accordingly, the pump performance is likely to vary.

For the same reason as the above, the diaphragm cannot be set closer to the second housing member than a certain distance, and hence the volumetric capacity of the pump chamber is unavoidably large relative to the vibration amplitude of the diaphragm. Accordingly, the self-priming capacity (maximum achievable vacuum) cannot be raised to a very high level.

When the first, second and third housing members are welded to each other by ultrasonic welding, the force with which the diaphragm (hence the silicon) is clamped between the first and second housing members is determined by the welding condition of the housing members. Therefore, the welding operation requires precise control. For this reason, it is necessary to perform separately the welding of the first and second housing members and the welding of the second and third housing members.

An object of the present invention is to solve the above-described problems.

Means for Solving the Problem

That is, the present invention provides a pump using a unimorph diaphragm.

The pump includes a first housing member (denoted by reference numeral 14 in the following description of embodiments) and a second housing member (16) stacked on the first housing member (14). The second housing member (16) has a fluid inlet (18) and a fluid outlet (20) extending therethrough in a direction in which the second housing member is stacked on the first housing member. The second housing member further has a suction opening (22) that opens on a side surface thereof to suck in a fluid from the outside and a discharge opening (24) that opens on another side surface thereof to discharge the fluid to the outside. The second housing member defines, in cooperation with the first housing member (14), a space (26) communicated with the fluid inlet (18) and the fluid outlet (20). The pump further includes a third housing member (30) stacked on the second housing member (16). The third housing member (30) defines, in cooperation with the second housing member, an inlet-side chamber (32) communicated with the suction opening (22) and the fluid inlet (24), and an outlet-side chamber (34) communicated with the discharge opening (24) and the fluid outlet (20). Further, the pump includes a diaphragm (40) set between the first and second housing members to divide the space (26) into a pump chamber (36) defined between the diaphragm and the second housing member to communicate with the fluid inlet (18) and the fluid outlet (20) and a chamber (38) defined between the diaphragm and the first housing member. Further, the pump includes a first check valve (42) set at the fluid inlet (18) to allow only the flow of fluid from the inlet-side chamber (32) to the pump chamber (36), and a second check valve (44) set at the fluid outlet (20) to allow only the flow of fluid from the pump chamber (36) to the outlet-side chamber (34). The diaphragm is a unimorph diaphragm (40) made from a thin sheet metal (46) and a thin piezoelectric element (48) that is disposed on a surface of the sheet metal on the side thereof closer to the first housing member. The piezoelectric element (48) is located inside the peripheral edge of the surface. The first and second housing members respectively have first and second abutting portions (66 and 68) that abut against each other when the first and second housing members are stacked on one another. The second and third housing members respectively have third and fourth abutting portions (70 and 72) that abut against each other when the second and third housing members are stacked on one another. The first and third housing members are fixed to each other in a state where the first, second and third housing members are stacked on one another such that the first and second abutting portions (66 and 68) are abutted against each other and the third and fourth abutting portions (70 and 72) are abutted against each other.

That is, in this pump, the first and third housing members are welded so as to be fixed to each other in a state where the first, second and third housing members are stacked on one another such that the first and second abutting portions are abutted against each other and the third and fourth abutting portions are o abutted against each other. Therefore, the relative positional relationship between the first and second housing members in the superimposing direction is determined independently of the fixing condition of the first and third housing members, and so is the relative positional relationship between the second and third housing members in the superimposing direction. Accordingly, the thickness of the pump chamber (36) formed between the diaphragm (40) and the second housing member (16), and hence the volumetric capacity of the pump chamber, is definitely determined. Thus, it is possible to obtain accurate performance of the pump, i.e. discharge flow rate and discharge pressure.

Specifically, the pump may be arranged as follows. The chamber (38) defined between the diaphragm (40) and the first housing member (16) is a vent chamber that is in communication with the outside air. The pump further includes an annular seal member (50) compressively held between the second housing member and the peripheral edge of the sheet metal (46) of the unimorph diaphragm (40) on a side thereof facing the second housing member. The peripheral edge of the sheet metal of the unimorph diaphragm on a side thereof facing the first housing member (14) is pressure-engaged with the ridge portion of an annular projection (52) annularly provided on the first housing along the peripheral edge of the vent chamber in the first housing member, so that the unimorph diaphragm is held between the annular projection and the annular seal member.

Thus, the peripheral edge of the diaphragm (40) is engaged and supported by the ridge portion of the annular projection (52) of the first housing member. Therefore, when the diaphragm bends as it vibrates, the peripheral edge portion thereof can move freely. Accordingly, vibration of the diaphragm is performed even more appropriately. Further, because the positional relationship between the first to third housing members is definitely determined, the degree of compression of the annular seal member is also definitely determined.

More specifically, the pump may be arranged as follows. The annular projection (52) has an arcuate sectional shape, and the annular seal member (50) is an O-ring. The annular projection and the O-ring engage mutually opposing portions on the opposite sides of the sheet metal (46).

Thus, the O-ring and the annular projection support the diaphragm from mutually opposing directions. Therefore, when the diaphragm vibrates, vibration of the peripheral edge of the diaphragm is performed even more appropriately.

The pump may further include a partition member (56) provided between the second housing member (16) and the third housing member (30) to divide the inlet-side chamber (32) into a fluid inlet chamber (58) on the second housing member side and a first pulsation absorbing chamber (60) on the third housing member side. The partition member further divides the outlet-side chamber (34) into a fluid outlet chamber (62) on the second housing member side and a second pulsation absorbing chamber (64) on the third housing member side.

The first and second pulsation absorbing chambers absorb pulsation in the fluid inlet and outlet chambers corresponding thereto respectively.

Specifically, the pump may be arranged as follows. The second housing member (16) has a flat plate shape as a whole and has a first annular wall (76) and a second annular wall (78) on a surface thereof on the side closer to the third housing member. The first annular wall (76) defines the periphery of the inlet-side chamber (32). The second annular wall (78) defines the periphery of the outlet-side chamber (34). The third housing member (30) has a flat plate shape as a whole. The partition member (56) has a first annular seal portion (80) pressed between the first annular wall (76) of the second housing member and a surface of the third housing member on the side thereof closer to the second housing member. The partition member (56) further has a second annular seal portion (82) pressed between the second annular wall (78) of the second housing member and a surface of the third housing member on the side thereof closer to the second housing member. Further, the partition member (56) has a first flat partition portion (84) integrally formed with the first annular seal portion (80), stretching so as to close the opening in the first annular seal portion (80) and to contact the distal end edge of the first annular wall (76) that presses the first annular seal portion (80), thereby separating the inlet-side chamber (32) into a second housing member side and a third housing member side. Further, the partition member (56) has a second flat partition portion (86) stretched so as to close the opening in the second annular seal portion (82) and to contact the distal end edge of the second annular wall (78) that presses the second annular seal portion, thereby separating the outlet-side chamber (34) into a second housing member side and a third housing member side. Furthermore, the partition member (56) has a flat connecting portion (88) provided between the first and second annular seal portions. The first annular seal portion (80) forms the first pulsation absorbing chamber (60) in cooperation with the first flat partition portion (84) and the surface of the third housing member on the side thereof closer to the second housing member. The second annular seal portion forms the second pulsation absorbing chamber (64) in cooperation with the second flat partition portion and the surface of the third housing member on the side thereof closer to the second housing member.

In this case, in short, first and second pulsation absorbing chambers respectively having the thicknesses of the first and second annular seal portions are formed.

Preferably, the surface of the third housing member (30) on the side thereof closer to the second housing member has first and second support projections (89 and 90) respectively located radially inside the first and second annular seal portions (80 and 82) to support them from radially inside. Further, the surface of the third housing member on the side thereof closer to the second housing member has a first outer support wall (92) disposed outside the first and second annular walls (76 and 78) of the second housing member. The first outer support wall (92) has an inner peripheral surface that is partly and substantially in contact with the outer peripheral surface of each of the first and second annular walls. The third housing member is stacked on the second housing member with the first outer support wall placed the first and second annular walls (76 and 78) so that the inner peripheral surface thereof is partly and substantially brought into contact with the outer peripheral surface of each of the first and second annular walls, thereby allowing the first and second annular seal portions (80 and 82) to be pressed between the first and second annular walls and the surface of the third housing member on the side thereof closer to the second housing member. Preferably, the surface of the second housing member on the side thereof closer to the third housing member has second and third outer support walls (94 and 96) respectively disposed outside and adjacent to portions of the first and second annular seal portions that are not supported by the first outer support wall (92) from outside and that are not connected by the flat connecting portion (88). The second and third outer support walls (94 and 96) are designed to support the above-described portions of the first and second annular seal portions from outside.

That is, the above-described structure supports the first and second annular seal portions (80 and 82) of the partition member to surely retain the partition member.

Further, the pump may be arranged as follows. The outer peripheral surface of the second housing member is substantially aligned with the outer peripheral surface of the first outer support wall (92) of the third housing member in the direction in which the first to third housing members are stacked on one another. The first housing member is in the shape of a cap having an outer peripheral wall (102) extending outside and adjacent to the outer peripheral surface of the first outer support wall (92) and the outer peripheral surface of the second housing member. The cap-shaped first housing member is stacked over the second housing member stacked on the third housing member so that the outer peripheral wall thereof extends adjacent to the outer peripheral surface of the second housing member and the outer peripheral surface of the first outer support wall.

That is, the above-described arrangement can facilitate the superimposition of the first to third housing members.

The pump may also be arranged as follows. The second housing member has a suction pipe (104) extending outward sideways from the first annular wall and having the suction opening. The second housing member further has a discharge pipe (106) extending outward sideways from the second annular wall and having the discharge opening. The outer peripheral wall (102) of the first housing member and the first outer support wall (92) of the third housing member have recesses (110 and 108) for allowing passage of the suction pipe and the discharge pipe, respectively.

The above-described arrangement enables the first to third housing members to be accurately stacked on one another simply by setting them such that the recesses (108 and 110) are fitted with the suction and discharge pipes.

Further, the flat connecting portion (88) may be stretched to connect the respective substantially central portions in the thickness direction of the first and second annular seal portions (80 and 82).

Providing the flat connecting portion with respect to the first and second annular seal portions as stated above can eliminate unbalanced movement of the first and second annular seal portions relative to the flat connecting portion. Accordingly, it is possible to stably retain the first and second annular seal portions.

In one embodiment, the first housing member has an air release groove (120) on an outer side surface (112) thereof in the housing member superimposing direction. The air release groove (120) extends from the vent hole (12) to the distal end. At least one portion of the air release groove (120) is curved. The outer side surface has a sheet-shaped seal member (118) bonded thereto. The air release groove (120) is communicated with atmospheric air at the distal end thereof.

In another embodiment, the first housing member has a passage (126) for passing lead wires (124) extending from the piezoelectric element (48), which is in the vent chamber (38), to the outside. The passage (126) extends from the vent chamber (38), meandering in the first housing member, and has a portion narrower than the diameter of the lead wires so that the lead wires are clamped by that portion of the passage.

That is, the above-described structure prevents any possible tensile force applied to the lead wires from being transmitted to the joint of the lead wires to the diaphragm.

BRIEF DESCRIPTION OF THE DRAWINGS

[FIG. 1] is a plan view of a pump 10 according to the present invention.

[FIG. 2] is a side view of the pump according to the present invention.

[FIG. 3] is a partly-cutaway bottom view of the pump according to the present invention.

[FIG. 4] is a longitudinal sectional view of the pump according to the present invention.

[FIG. 5] is a sectional view taken along the line V-V in FIG. 4.

[FIG. 6] is an exploded perspective view of the pump according to the present invention.

[FIG. 7] is an enlarged view of a part of FIG. 4.

[FIG. 8] is a bottom view of a second housing member of the pump according to the present invention.

EXPLANATION OF REFERENCE NUMERALS pump 10; vent hole 12; peripheral edge surface 13; first housing member 14; disk-shaped surface 15; second housing member 16; fluid inlet 18; fluid outlet 20; suction opening 22; discharge opening 24; space 26; third housing member 30; inlet-side chamber 32; outlet-side chamber 34; pump chamber 36; vent chamber 38; unimorph diaphragm (diaphragm) 40; valve installation hole 41; first check valve 42; valve installation hole 43; second check valve 44; sheet metal 46; piezoelectric element 48; annular seal member 50; annular projection 52; partition member 56; fluid inlet chamber 58; first pulsation absorbing chamber 60; fluid outlet chamber 62; second pulsation absorbing chamber 64; first abutting portion 66; second abutting portion 68; third abutting portion 70; fourth abutting portion 72; first annular wall 76; second annular wall 78; first annular seal portion 80; second annular seal portion 82; first flat partition portion 84; second flat partition portion 86; flat connecting portion 88; first support projection 89; second support projection 90; first outer support wall 92; second outer support wall 94; third outer support wall 96; outer peripheral surface 98; outer peripheral surface 100; outer peripheral wall 102; suction pipe 104; discharge pipe 106; outer side surface 112; spiral portion 114; straight-line portion 116; sheet-shaped seal member 118; air release groove 120; annular groove 122; lead wires 124; passage 126; projections 130.

BEST MODE FOR CARRYING OUT THE INVENTION

An embodiment of a pump 10 using a unimorph diaphragm according to the present invention will be explained below with reference to the accompanying drawings.

As will be understood from FIGS. 4 to 6, the pump 10 according to the present invention has first to third housing members 14, 16 and 30 that are stacked on one another. The first housing member 14 has a vent hole 12 extending therethrough in a superimposing direction in which the housing members 14, 16 and 30 are stacked on one another. The second housing member 16 has a fluid inlet 18 and a fluid outlet 20 that extend therethrough in the superimposing direction. In addition, the second housing member 16 has a suction opening 22 that opens on a side surface thereof to suck in a fluid from the outside. The second housing member 16 further has a discharge opening 24 that opens on another side surface thereof to discharge the fluid to the outside. The second housing member 16 defines, in cooperation with the first housing member 14, a space 26 communicated with the vent hole 12, the fluid inlet 18 and the fluid outlet 20. The third housing member 30 defines, in cooperation with the second housing member 16, an inlet-side chamber 32 communicated with the suction opening 22 and the fluid inlet 18, and an outlet-side chamber 34 communicated with the discharge opening 24 and the fluid outlet 20.

The pump further has a unimorph diaphragm 40 set between the first and second housing members 14 and 16 to divide the space 26 into a pump chamber 36 communicated with the fluid inlet 18 and the fluid outlet 20 and a vent chamber 38 communicated with the vent hole 12. Further, the pump has a first check valve 42 and a second check valve 44. The first check valve 42 is set at the fluid inlet 18 to allow only the flow of fluid from the inlet-side chamber 32 to the pump chamber 36. The second check valve 44 is set at the fluid outlet 20 to allow only the flow of fluid from the pump chamber 36 to the outlet-side chamber 34.

The diaphragm 40 is a unimorph diaphragm formed from a thin sheet metal 46, e.g. brass, and a thin piezoelectric element 48 that is stacked on a surface of the sheet metal 46 on the side thereof closer to the vent chamber 38 so as to be located inside the peripheral edge of the surface. It should be noted that a surface of the sheet metal 46 on the side thereof closer to the pump chamber 36 is insulated by bonding a Teflon (registered trademark) sheet thereto. An annular seal member 50, e.g. an O-ring, is provided between the second housing member 16 and the peripheral edge of the sheet metal 46 of the unimorph diaphragm 40 on a side thereof facing the second housing member 16.

As shown in the enlarged view of FIG. 7, the peripheral edge of the sheet metal 46 of the unimorph diaphragm 40 on a side thereof facing the first housing member 14 is pressure-engaged with the ridge portion of an annular projection 52 (i.e. the line connecting the peaks of projections) annularly provided along the peripheral edge of the vent chamber 38. Thus, the unimorph diaphragm 40 is held between the annular projection 52 and the annular seal member 50. As shown in FIG. 7, the annular projection 52 has an arcuate sectional shape and engages the sheet metal 46 at a position facing the O-ring serving as the annular seal member 50.

Let us explain in more detail: The second housing member 16 has a disk-like shape as a whole. The surface of the second housing member 16 on the side thereof facing the first housing member 14 has an annular peripheral edge surface 13 and a stepped disk-shaped surface 15 inside the peripheral edge surface 13. The annular seal member 50 is engaged with the peripheral edge surface 13. The sheet metal 46 of the unimorph diaphragm 40 is set so as to substantially contact the disk-shaped surface 15 of the second housing member 16. The fluid inlet 18 comprises a plurality of circularly spaced inlets. A valve installation hole 41 is provided at the center of the circularly provided inlets constituting the fluid inlet 18 to allow insertion of the stem portion of the check valve 42 therethrough to install it. Similarly, the fluid outlet 20 comprises a plurality of circularly spaced outlets. A valve installation hole 43 is provided at the center of the circularly provided outlets constituting the fluid outlet 20 to allow insertion of the stem portion of the check valve 44 therethrough to install it. As will be understood from FIG. 6, the disk-shaped surface 15 has circular recesses formed in portions thereof where the fluid inlet 18 and the fluid outlet 20 open, respectively. The circular recesses are connected to each other by a connecting recess to form a fluid flow path in the pump chamber 36. The check valve 42 has its head accommodated in the associated circular recess formed in the disk-shaped surface 15. The head of the check valve 42 is deformed in response to the vibration of the diaphragm 40 to open or close the fluid inlet 18. The check valve 44 is set in the opposite direction to the check valve 42. The head of the check valve 44 performs an opening-closing operation in reverse relation to that of the check valve 42 in response to the vibration of the diaphragm 40.

A partition member 56 is provided between the second housing member 16 and the third housing member 30 to divide the inlet-side chamber 32 into a fluid inlet chamber 58 on the side thereof closer to the second housing member 16 and a first pulsation absorbing chamber 60 on the side thereof closer to the third housing member 30. The partition member 56 further divides the outlet-side chamber 34 into a fluid outlet chamber 62 on the side thereof closer to the second housing member 16 and a second pulsation absorbing chamber 64 on the side thereof closer to the third housing member 30.

Explaining in detail, as will be understood from FIGS. 4 and 8, the surface of the second housing member 16 on the side thereof closer to the third housing member 30 is provided with a semicircular first annular wall 76 that defines the periphery of the fluid inlet chamber 58, and a second annular wall 78 (having a semicircular shape larger than the first annular wall 76) that defines the periphery of the fluid outlet chamber 62.

The partition member 56 includes a semicircular first annular seal portion 80, a second annular seal portion 82, a first flat partition portion 84, a second flat partition portion 86, and a flat connecting portion 88. The first annular seal portion 80 is pressed between the first annular wall 76 of the second housing member 16 and the surface of the third housing member 30 (having a flat plate shape as a whole) on the side thereof closer to the second housing member 16. The second annular seal portion 82 is pressed between the second annular wall 78 of the second housing member 16 and the surface of the third housing member 30 on the side thereof closer to the second housing member 16. The first flat partition portion 84 is integrally formed with the first annular seal portion 80, stretching so as to close the opening in the first annular seal portion 80 and to contact the distal end edge of the first annular wall 76 that presses the first annular seal portion 80, thereby separating the inlet-side chamber 32 into the fluid inlet chamber 58 and the first pulsation absorbing chamber 60. The second flat partition portion 86 is integrally formed with the second annular seal portion 82, stretching so as to close the opening in the second annular seal portion 82 and to contact the distal end edge of the second annular wall 78 that presses the second annular seal portion 82, thereby separating the outlet-side chamber 34 into the fluid outlet chamber 62 and the second pulsation absorbing chamber 64. The flat connecting portion 88 is provided between the first and second annular seal portions 80 and 82. The flat connecting portion 88 interconnects the first and second annular seal portions 80 and 82 at the substantially central portions in the thickness direction thereof.

As will be understood from FIGS. 1 and 6, the surface of the third housing member 30 on the side thereof closer to the second housing member 16 has semicircular first and second support projections 89 and 90 respectively located radially inside the first and second annular seal portions 80 and 82 to support them. Further, the third housing member 30 has a cylindrical first outer support wall 92 provided outside the first and second annular walls 76 and 78 of the second housing member 16. The first outer support wall 92 has an inner peripheral surface that is substantially in contact at one portion thereof with the outer peripheral surface of each of the first and second annular walls 76 and 78. The third housing member 30 is stacked on the second housing member 16 with the first outer support wall 92 fitted to the first and second annular walls 76 and 78 so that the inner peripheral surface of the first outer support wall 92 contacts one portion of the outer peripheral surface of each of the first and second annular walls 76 and 78, thereby supporting the first and second annular seal portions 80 and 82 from radially outside when the first and second annular seal portions 80 and 82 are pressed between the first and second annular walls 76 and 78 and the surface of the third housing member 30 on the side thereof closer to the second housing member 16. Further, the surface of the second housing member 16 on the side thereof closer to the third housing member 30 has second and third outer support walls 94 and 96 (FIG. 8) respectively provided outside and adjacent to portions of the first and second annular seal portions 80 and 82 that are not supported by the first outer support wall 92 from the outside and that are not connected by the flat connecting portion 88. The second and third outer support walls 94 and 96 support the above-described portions of the first and second annular seal portions 80 and 82 from the outside. In the illustrated example, the second and third outer support walls 94 and 96 are integrally formed with the first and second annular walls 76 and 78.

That is, the first and second support projections 89 and 90 and the first, second and third outer support walls 92, 94 and 96 support and retain the first and second annular seal portions 80 and 82 of the partition member from radially outside and inside.

The outer peripheral surface 98 of the second housing member 16 is substantially aligned with the outer peripheral surface 100 of the first outer support wall 92 in the superimposing direction of the first to third housing members. Meanwhile, the first housing member 14 is in the shape of a cap having an outer peripheral wall 102 extending outside and adjacent to the outer peripheral surface 100 of the first outer support wall 92 and the outer peripheral surface 98 of the second housing member 16. The cap-shaped first housing member 14 is stacked over the second housing member 16 stacked on the third housing member 30 so that the outer peripheral wall 102 extends adjacent to the outer peripheral surface 98 of the second housing member 16 and the outer peripheral surface 100 of the first outer support wall 92. The second housing member 16 has a suction pipe 104 extending outward sideways from the first annular wall 76 and having the suction opening 22. The second housing member 16 further has a discharge pipe 106 extending outward sideways from the second annular wall 78 and having the discharge opening 24. The outer peripheral wall 102 of the first housing member 14 and the first outer support wall 92 of the third housing member 30 respectively have recesses 110 and 108 for allowing passage of the suction pipe 104 and the discharge pipe 106. That is, when the first to third housing members are stacked on one another, the recesses 108 and 110 are radially aligned with each other to allow passage of the suction pipe 104 and the discharge pipe 106 extending from the inside to the outside.

The first housing member 14 has an air release groove 120 on an outer side surface 112 in the superimposing directions of the housing members. The air release groove 120 includes a spiral portion 114 extending from the vent hole 12 and a straight-line portion 116 extending from the spiral portion 114. The outer side surface 112 has a circular seal member 118 bonded thereto to seal the vent hole 12 and the spiral and straight-line portions 114 and 116 of the air release groove 120. The straight-line portion 116 has its distal end connected to an annular groove 122 formed on the outer side surface 112. Thus, the straight-line portion 116 is communicated with the outside air.

As shown in FIG. 3, the first housing member 14 has a passage 126 for passing lead wires 124 extending from the unimorph diaphragm 40 to the outside of the first housing member 14. The passage 126 is provided to meander in the first housing member 14 and has a portion narrower than the diameter of the lead wires 124 so that the lead wires 124 are clamped by that portion of the passage 126.

The first and second housing members 14 and 16 respectively have first and second abutting portions 66 and 68 (FIG. 5) that abut against each other when the first and second housing members 14 and 16 are stacked on one another. The second and third housing members 16 and 30 respectively have third and fourth abutting portions 70 and 72 (FIG. 5) that abut against each other when the second and third housing members 16 and 30 are stacked on one another. The first, second and third housing members 14, 16 and 30 are molded from a resin material. In a state where the first, second and third housing members 14, 16 and 30 are stacked on one another such that the first and second abutting portions 66 and 68 are abutted against each other and the third and fourth abutting portions 70 and 72 are abutted against each other, the first and third housing members 14 and 30 are welded to connect and fix together the first to third housing members. In the illustrated example, arcuate projections 130 are formed outside the first outer support wall 92 of the third housing member 30. When the first to third housing members are stacked on one another, the end surface of the outer peripheral wall 102 of the first housing member 14 abuts against the projections 130. While the first and third housing members 14 and 30 are being pressed against each other, the projections 130 are ultrasonic-welded to the end surface of the outer peripheral wall 102, thereby bringing the first and second abutting portions 66 and 88 into abutting contact with each other and also bringing the third and fourth abutting portions 70 and 72 into abutting contact with each other.

Accordingly, in a state where the first and third housing members are welded and thus the first to third housing members are connected and fixed together, the second housing member is clamped and fixed between the first and third housing members.

The invention claimed is:

1. A pump using a unimorph diaphragm, the pump comprising:

a first housing member;

a second housing member stacked on the first housing member, the second housing member having a fluid inlet and a fluid outlet extending therethrough in a direction in which the second housing member is stacked on the first housing member, the second housing member further having a suction opening that opens on a side surface thereof to suck in a fluid from an outside and a discharge opening that opens on another side surface thereof to discharge the fluid to the outside, the second housing member defining, in cooperation with the first housing member, a space communicated with the fluid inlet and the fluid outlet;

a third housing member stacked on the second housing member, the third housing member defining, in cooperation with the second housing member, an inlet-side chamber communicated with the suction opening and the fluid inlet, and an outlet-side chamber communicated with the discharge opening and the fluid outlet;

a diaphragm set between the first housing member and the second housing member to divide the space into a pump chamber defined between the diaphragm and the second housing member to communicate with the fluid inlet and the fluid outlet and a chamber defined between the diaphragm and the first housing member;

a first check valve set at the fluid inlet to allow only a flow of fluid from the inlet-side chamber to the pump chamber; and a second check valve set at the fluid outlet to allow only a flow of fluid from the pump chamber to the outlet-side chamber;

a partition member provided between the second housing member and the third housing member to divide the inlet-side chamber into a fluid inlet chamber on a side thereof closer to the second housing member and a first pulsation absorbing chamber on a side thereof closer to the third housing member, the partition member further dividing the outlet-side chamber into a fluid outlet chamber on the side thereof closer to the second housing member and a second pulsation absorbing chamber on the side thereof closer to the third housing member;

wherein the diaphragm is a unimorph diaphragm formed from a thin sheet metal and a thin piezoelectric element that is disposed on a surface of the sheet metal on a side thereof closer to the first housing member, the piezoelectric element being located inside a peripheral edge of the surface;

wherein the first housing member and second housing member have first and second abutting portions that abut against each other when the first housing member and second housing member are stacked on one another, and the second housing member and third housing member have third and fourth abutting portions that abut against each other when the second housing member and third housing member are stacked on one another;

wherein the first housing member and third housing member are fixed to each other in a state where the first housing member, second housing member and third housing member are stacked on one another such that the first and second abutting portions are abutted against each other and the third and fourth abutting portions are abutted against each other;

wherein the second housing member has a flat plate shape as a whole and has a first annular wall and a second annular wall on a surface thereof on a side closer to the third housing member, the first annular wall defining a periphery of the inlet-side chamber, the second annular wall defining a periphery of the outlet-side chamber;

the third housing member having a flat plate shape as a whole;

the partition member having:

a first annular seal portion pressed between the first annular wall of the second housing member and a surface of the third housing member on a side thereof closer to the second housing member;

a second annular seal portion pressed between the second annular wall of the second housing member and a surface of the third housing member on the side thereof closer to the second housing member;

a first flat partition portion integrally formed with the first annular seal portion, stretching so as to close an opening in the first annular seal portion and to contact a distal end edge of the first annular wall that presses the first annular seal portion, thereby separating the inlet-side chamber into a second housing member side and a third housing member side;

a second flat partition portion integrally formed with the second annular seal portion, stretching so as to close an opening in the second annular seal portion and to contact a distal end edge of the second annular wall that presses the second annular seal portion, thereby separating the outlet-side chamber into a second housing member side and a third housing member side; and a flat connecting portion provided between the first annular seal portion and second annular seal portion;

wherein the first annular seal portion forms the first pulsation absorbing chamber in cooperation with the first flat partition portion and the surface of the third housing member on the side thereof closer to the second housing member, and the second annular seal portion forms the second pulsation absorbing chamber in cooperation with the second flat partition portion and the surface of the third housing member on the side thereof closer to the second housing member.

2. The pump of claim 1, wherein the chamber defined between the diaphragm and the first housing member is a vent chamber that is in communication with an outside air;

the pump further comprising:

an annular seal member compressively held between the second housing member and a peripheral edge of the sheet metal of the unimorph diaphragm on a side thereof facing the second housing member;

wherein a peripheral edge of the sheet metal of the unimorph diaphragm on a side thereof facing the first housing member is pressure-engaged with a ridge portion of an annular projection annularly provided on the first housing along a peripheral edge of the vent chamber, so that the unimorph diaphragm is held between the annular projection and the annular seal member.

3. The pump of claim 2, wherein the annular projection has an arcuate sectional shape, and the annular seal member is an O-ring, the annular projection and the O-ring being designed to engage mutually opposing portions on opposite sides of the sheet metal.

4. The pump of claim 1, wherein the surface of the third housing member on the side thereof closer to the second housing member has a first support projection and a second support projection respectively located radially inside the first annular seal portion and second annular seal portion to support them from radially inside.

5. The pump of claim 1, wherein the surface of the third housing member on the side thereof closer to the second housing member has a first outer support wall provided outside the first annular wall and second annular wall of the second housing member, the first outer support wall having an inner peripheral surface that is partly and substantially in contact with an outer peripheral surface of each of the first annular wall and second annular wall, and the third housing member is stacked on the second housing member with the first outer support wall placed the first annular wall and second annular wall so that the inner peripheral surface thereof is partly and substantially brought into contact with the outer peripheral surface of each of the first annular wall and second annular wall, thereby allowing the first annular seal portion and second annular seal portion to be pressed between the first annular wall and second annular wall and the surface of the third housing member on the side thereof closer to the second housing member.

6. The pump of claim 5, wherein the surface of the second housing member on the side thereof closer to the third housing member has a second outer support wall and a third outer support wall respectively provided outside and adjacent to portions of the first annular seal portion and second annular seal portion that are not supported by the first outer support wall from outside and that are not connected by the flat connecting portion, the second outer support wall and third outer support wall being designed to support the portions of the first annular seal portion and second annular seal portion from outside.

7. The pump of claim 5, wherein the outer peripheral surface of the second housing member is aligned with an outer peripheral surface of the first outer support wall in a direction in which the first housing member, second housing member and third housing member are stacked on one another;

the first housing member being in a shape of a cap having an outer peripheral wall extending outside and adjacent to the outer peripheral surface of the first outer support wall and the outer peripheral surface of the second housing member, wherein the first housing member in the shape of a cap is stacked over the second housing member stacked on the third housing member so that the outer peripheral wall extends adjacent to the outer peripheral surface of the second housing member and the outer peripheral surface of the first outer support wall.

8. The pump of claim 5, wherein the second housing member comprises:

a suction pipe extending outward sideways from the first annular wall and having the suction opening; and a discharge pipe extending outward sideways from the second annular wall and having the discharge opening;

wherein the outer peripheral wall of the first housing member and the first outer support wall of the third housing member have recesses for allowing passage of the suction pipe and the discharge pipe, respectively.

9. The pump of claim 1, wherein the flat connecting portion is stretched to connect respective substantially central portions in a thickness direction of the first annular seal portion and second annular seal portion.

10. The pump of claim 1, wherein the first housing member has an air release groove on an outer side surface thereof in the direction in which the first housing member, second housing member and third housing member are stacked on one another, the air release groove extending from the vent hole to a distal end, at least one portion of the air release groove being curved;

the outer side surface having a seal member bonded thereto; and the air release groove being communicated with atmospheric air at a distal end thereof.

11. The pump of claim 1, wherein the first housing member has a passage for passing lead wires extending from the piezoelectric element to the outside, the passage extending from the vent chamber, meandering in the first housing member, and having a portion narrower than a diameter of the lead wires so that the lead wires are clamped by the portion of the passage.

* * * * *